US007077049B2

(12) United States Patent
Shumov et al.

(10) Patent No.: US 7,077,049 B2
(45) Date of Patent: Jul. 18, 2006

(54) ACTIVE PROTECTION SYSTEM

(75) Inventors: Sergei Aleksandrovich Shumov, Kiev (UA); Vasilij Onufrievich Khitryk, Kiev (UA); Vladimir Stanislavovich Medvid, Kiev (UA); Marina Ivanovna Poyhina, Kiev (UA)

(73) Assignee: S.A. Shumov, Kiev (UA)

( * ) Notice: Subject to any disclaimer, the term of this patent is extended or adjusted under 35 U.S.C. 154(b) by 55 days.

(21) Appl. No.: 10/810,470

(22) Filed: Mar. 27, 2004

(65) Prior Publication Data

US 2006/0107829 A1 May 25, 2006

(30) Foreign Application Priority Data

Apr. 8, 2003 (UA) ..... 2003043140

(51) Int. Cl.
*F41H 5/007* (2006.01)

(52) U.S. Cl. ..... 89/36.17; 89/36.15; 89/36.16

(58) Field of Classification Search ..... 89/36.15, 89/36.16, 36.17; 102/402, 404
See application file for complete search history.

(56) References Cited

U.S. PATENT DOCUMENTS

| | | | | |
|---|---|---|---|---|
| 3,875,844 | A * | 4/1975 | Hicks | 89/1.11 |
| 3,893,368 | A * | 7/1975 | Wales, Jr. | 89/36.17 |
| 5,001,984 | A * | 3/1991 | Jones et al. | 102/418 |
| 5,012,742 | A * | 5/1991 | Jones | 102/418 |
| 5,677,506 | A * | 10/1997 | Wallin | 89/38 |
| 6,128,999 | A * | 10/2000 | Sepp et al. | 89/36.17 |
| 6,408,763 | B1 * | 6/2002 | Hurtta et al. | 102/404 |
| 6,782,793 | B1 * | 8/2004 | Lloyd | 89/36.17 |
| 2003/0164087 | A1 * | 9/2003 | Vives et al. | 89/36.17 |

* cited by examiner

*Primary Examiner*—Stephen M. Johnson
(74) *Attorney, Agent, or Firm*—Ilya Zborovsky

(57) ABSTRACT

A system of active protection system of objects has a central control panel, and at least one unit arrangeable on a protected object and including a target detection device, a protective ammunition connected with the target detection device, a device for moving the target detection device and the protective ammunition device, and a case accommodating the target detection device, the protective ammunition, and the moving out device, so that when the target detection device of the at least one unit detects a target, the ammunition of the at least one unit is moved out of the case and fired.

14 Claims, 7 Drawing Sheets

ACTIVE PROTECTION SYSTEM

BACKGROUND OF THE INVENTION

The present invention relates to armaments, in particular to means for active protection of military equipment from high-speed destruction means, or in other words to active protection systems.

Active protection systems are known in the art. In particular, there are already known active protective systems which use the effect of reciprocal (in relation to incoming destruction means) explosion. One of such active protective systems is disclosed in the French patent application no. 2676536. It includes at least one system of launching elements made of pipes, which house protective ammunition. The launching elements are arranged so that they create a protection zone in the form of arcs of a circle. The system has a protective ammunition launch control unit and means for detection of outside objects. The detection means include a system of detectors which are located within the controlling area and connected to the central control unit.

This system has the disadvantage in the existence of devices for detection of outside objects placed in the protected zone, which increases the reaction time for protective ammunition. In addition, the location of the devices for detection of outside objects at a range far away from the launching pad makes the use of this invention, for example on tanks, in applicable in practice.

Another active protection system is described in the website http://armor.vif2.ru/tanks.EQP/arna.html. This known system includes a radar mount on the tank turret. A control panel placed in the turret and protective ammunition arranged around the turret. This system can be considered as a prototype, and it possess some disadvantages. In particular the location of the radar on the turret is disadvantageous, since in case of getting hit by, for example small arms or shell-splinters, or mine-splinters, the entire active protection system actually becomes "blind" and will be completely out of operation. Also, the arrangement of protective ammunition around the turret decreases the reliability and protective performance of the entire system, because their concentration at the turret area increases the likelihood of their destruction by splinters, high-caliber machine-gun bullets, etc. The above described disadvantages reduce the reliability of this known active protection system.

SUMMARY OF THE INVENTION

Accordingly, it is an object of the present invention to provide an active protective system which avoids the disadvantages of the prior art.

In accordance with the present invention an active protective system is proposed in which protective ammunition and devices for detection of high-speed and slow-speed incoming means are combined in a single autonomous unit, and such units are arranged around the perimeter of a tank and on its turret to substantially improve the tactical and technical performance of the system and its reliability.

In keeping with these objects and with others which will become apparent hereinafter, one feature of the present invention resides, briefly stated, in an active protective system including a central control panel; and at least one unit arrangeable on a protected object and including a target detection device and a protective ammunition connected with said target detection device, and a case accommodating said target detection device and said ammunition so that when said target detection device of said at least one unit detects a target, said ammunition of said at least one unit is fired.

In accordance with another feature of the present invention, the case also accommodates means for jointly moving said target detection device and said ammunition out of said case toward a target.

In accordance with another feature of the present invention the case also accommodates a switching unit and a power supply unit.

In accordance with another feature of the present invention, the system of active protective protection of objects has a plurality of such units, each including the target detection device and the ammunition accommodated in the case, distributed over the object, in particular over its perimeter.

In accordance with still another feature of the present invention, in the inventive system of active protection of objects, the protective ammunition rounds can be linked through a radar to the devices moving them out toward the target.

Still another feature of the present invention resides in a system of active protection of objects, in which the means for moving the protective ammunition out towards the target includes helical racks linked to electrical engines and parts of direct movement along the racks of the radar-protective ammunition subsystem, which are formed for example as nuts.

In accordance with an additional feature of the present invention, each unit has two sets of interconnected target detection device and ammunition rounds, and the case has at least two outer openings each to move out a corresponding one of said sets away from the dimensions of the protected object.

In still an additional feature of the present invention, the cases are formed as autonomous protected cases which, together with the at least the target detection system and the ammunition, can be arranged on shelves over tracks and on a turret of the object.

The new features of the autonomous ammunition system in accordance with the present invention reside in implementing of each of the protective ammunition rounds firmly linked to the target detection device and to the means for moving protective ammunition out toward the target, in (electrical) connection both to the data and control system and especially in combining at least two protective ammunition rounds into a single autonomous unit which is located within the armored case. Such a design allows mounting of such units along the entire perimeter of the contour of the tank, and also on its turret, which improves tactical and technical performance of the entire system and its reliability.

The autonomous unit operate independently, protecting their sectors by reciprocal explosion when an object threatening the object, for example a tank, approaches, safeguarding the destruction of the object at a second, third, etc., attempts to hit the object along the same trajectory. Moving out of the protective ammunition toward an object threatening the tank pursues an important objective not to damage the tank armor, combat and technical infrastructure by protective explosion.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
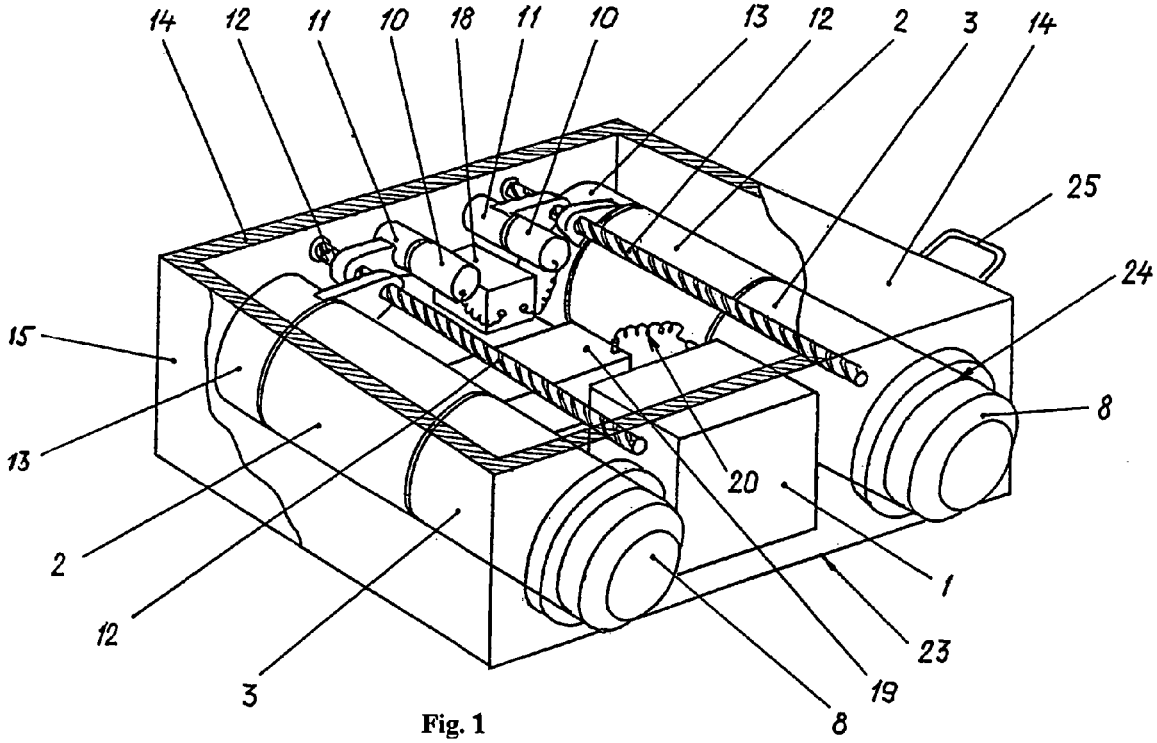
FIG. 1 is a view showing a unit or a module located within an armored case, of an active protection system in accordance with the present invention.

An active protection system in accordance with the present invention comprises a data and control system 1, a detection system 2, a target destruction system 3, a control panel 4, and a device 5 for blocking fire control circuits while hatches of an armored protected object 6 are open.

Figure 5:
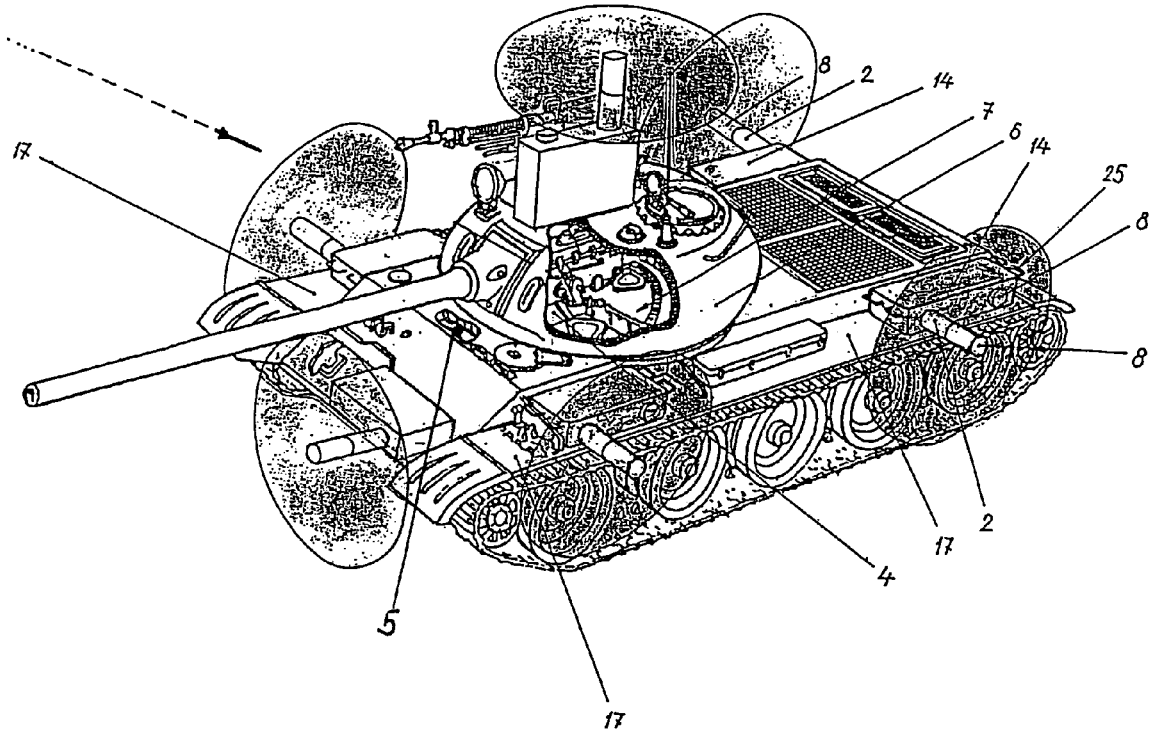
FIGS. 5–8 are views illustrating a process of interception of an incoming high-speed antitank means of various types, with the use of the active protective system in accordance with the present invention.

The detection system 2 can be formed for example as a radar. The control panel 4 is formed so that it can be placed within a fighting compartment 7 of the protected armored object 6, for example in a turret of a tank as shown in FIG. 5. The target destruction system 3 is formed as an interlinked protective ammunition 8 and a device moving out the protective ammunition 8 toward the incoming anti-tank means (the target). The protective ammunition 8 is firmly connected to the radar to form a unit as shown in FIGS. 1 and 3.

Figure 2:
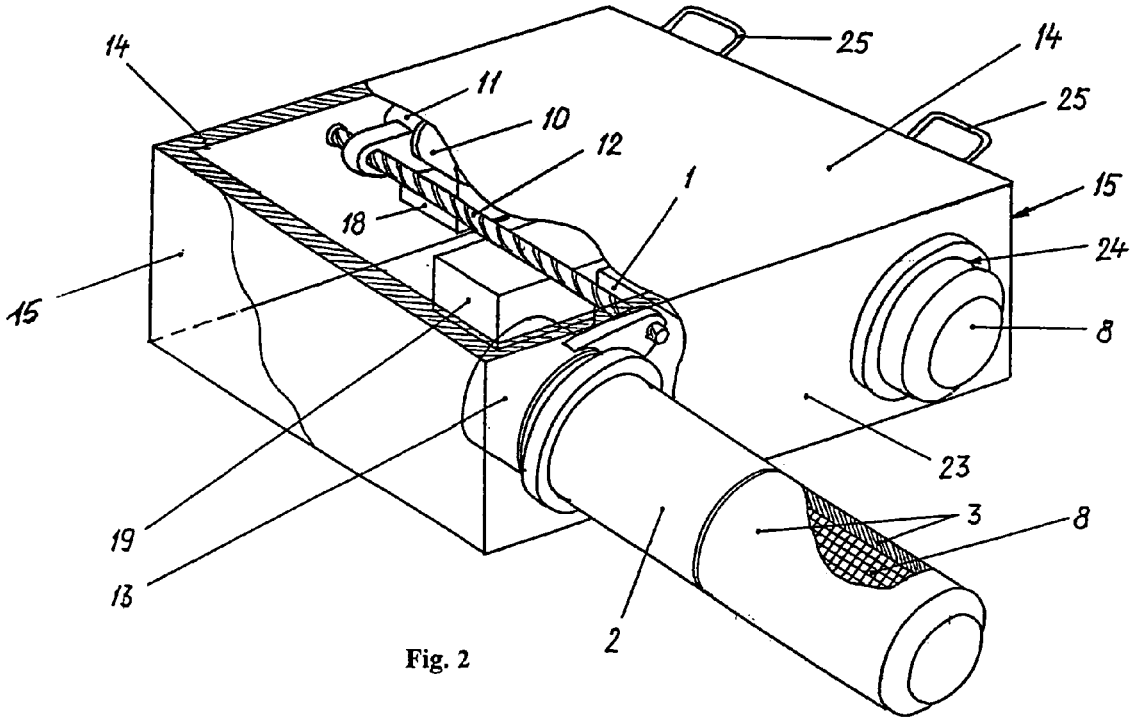
FIG. 2 is a view showing the module with a protective ammunition round moved away from body dimensions and a radar of a target detection device, of the inventive active protection system.
Figure 3:
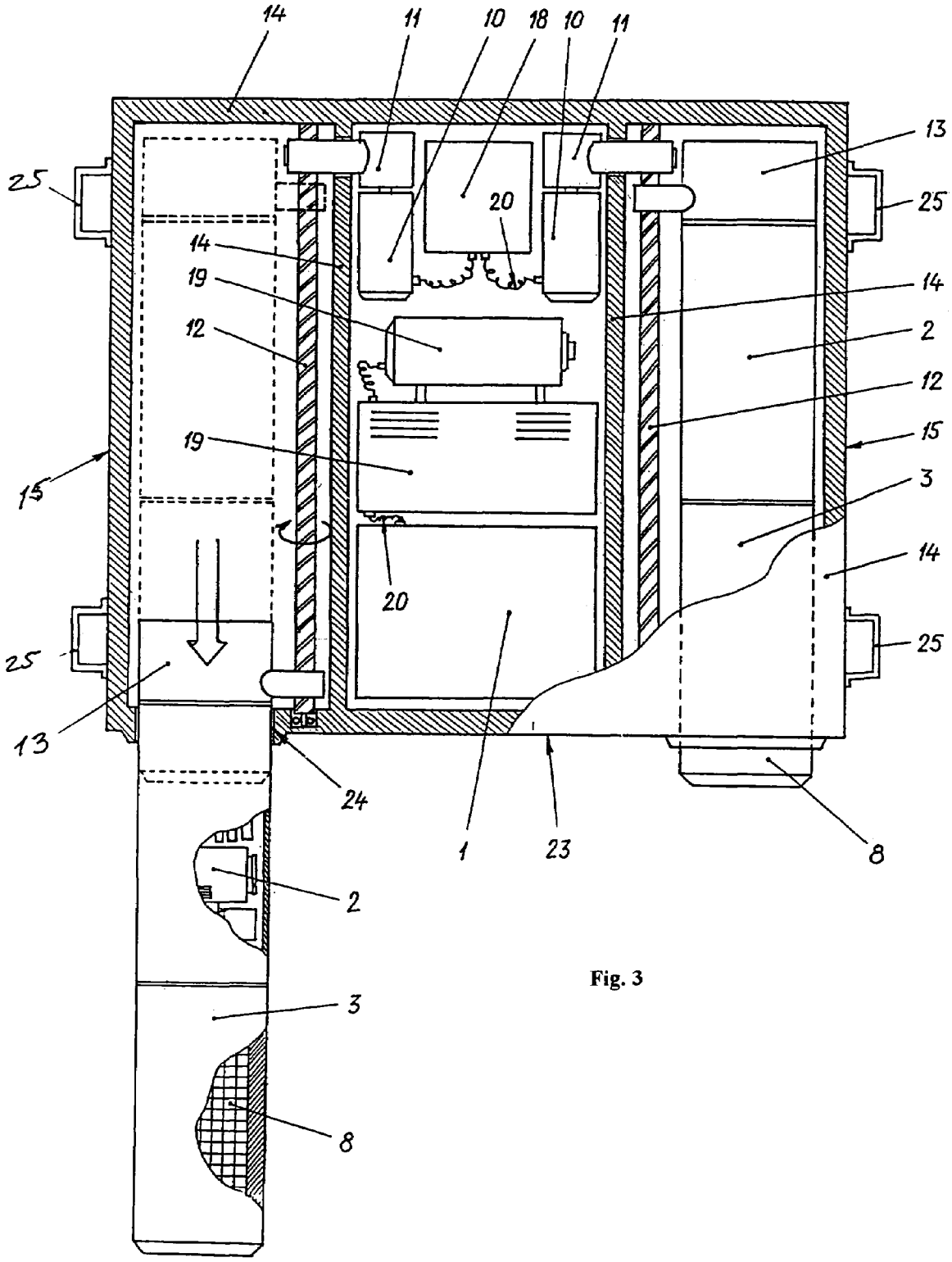
FIG. 3 is a view showing a device for moving out ammunition toward an incoming antitank means, of the inventive active protection system.

The device for moving out protective ammunition 8 toward the incoming antitank means 9 includes for example an electrical motor 10 with a reducer 11, a directing helical rack 12, and a power base 13 fixed to the helical rack 12 and capable of moving along it towards a front limit position shown in FIG. 3, in which the radar and the protective ammunition 8 interlinked into a block are completely moved out away from the case 14 (or its outer walls). The case 14 is preferably armored. The radar and the protective ammunition 8 are accommodated within the armored case 14 near its sides 15, while the ammunition elements (ammunition rounds) 8 are located inside the case 14 parallel to each other and symmetrical relative to the geometrical interior of the case 14, as shown in FIGS. 1 and 2.

As can be seen for example from FIG. 1, two control systems 1, two detection systems 2, and two target destruction systems 3 can be accommodated in the armored case 14. It is also possible to have 2, 4, 6, 8, and more of these components. The components 1, 2 and 3 are accommodated within an entire autonomous combat unit. Each of the units is placed within the armored case 14 in between the linked into a unit radars 2 and protective ammunition 8.

Figure 4:
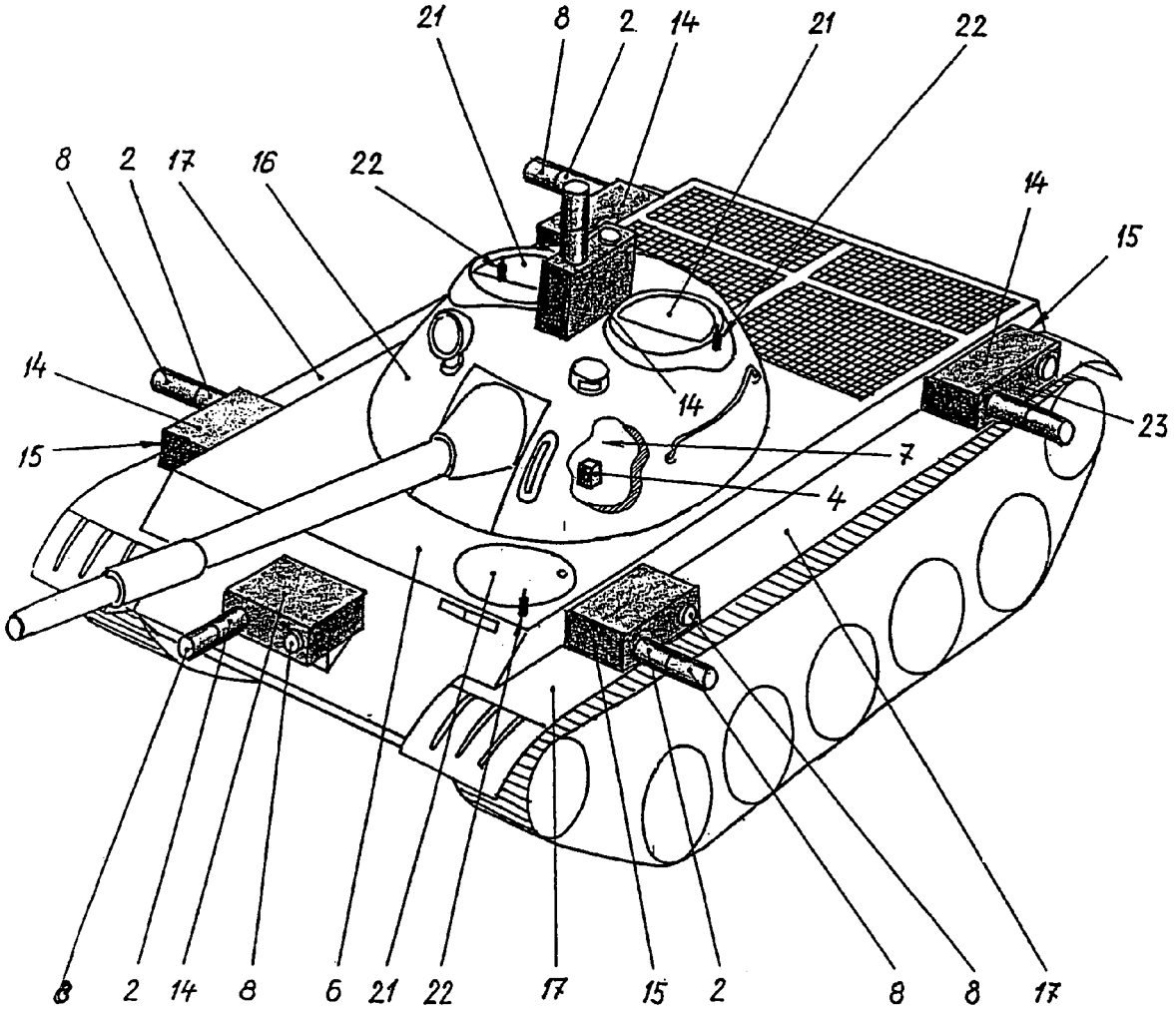
FIG. 4 is a view showing a tank with an active protection system in accordance with the present invention installed on it.

The units or modules are arranged both on a turret 16 of the protected armored object 6 and on shelves over tracks 17 along the perimeter of the protected object, as shown in FIGS. 4 and 5. Each module additionally includes a switching unit 18 and a power supply unit 19. The switching unit 18 and the power supply unit 19 are also accommodated in the armored case 14. The control panel 4 has an outlet which is linked to inputs of the components 1, 2 and 3 and to an input of the switching unit 18 of all modules. The switching units 18 in the modules have outputs which are linked to both electric engines 10 for moving the power base 13 along the helical rack 12.

Figure 6:
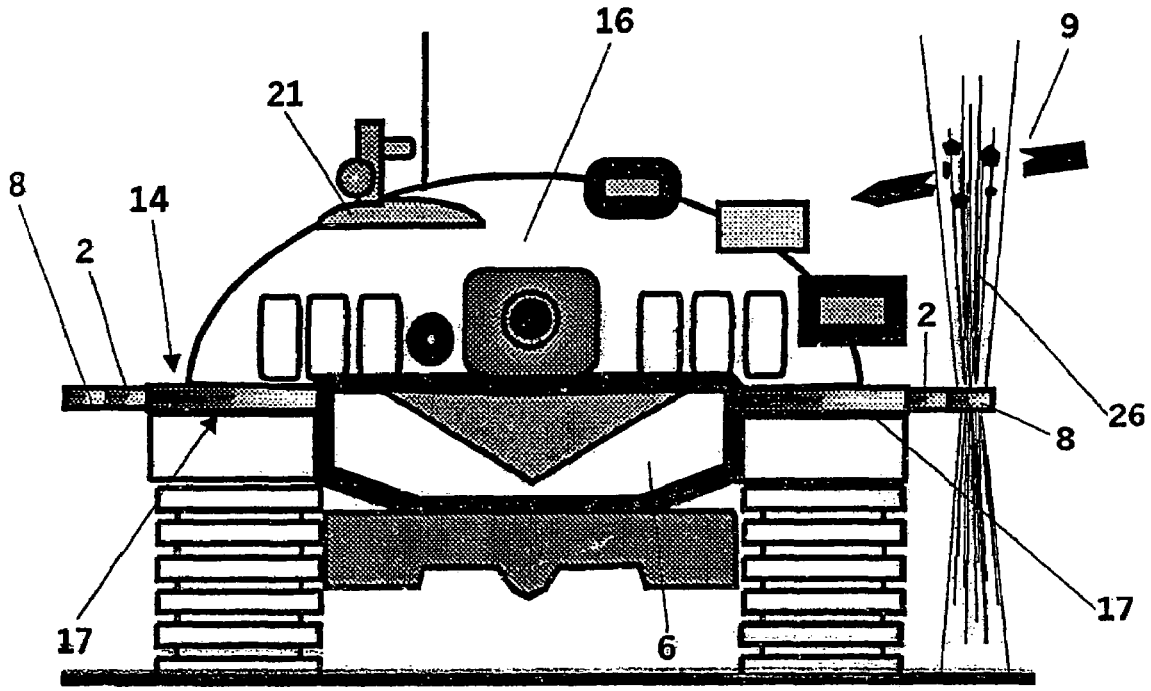
Figure 7:
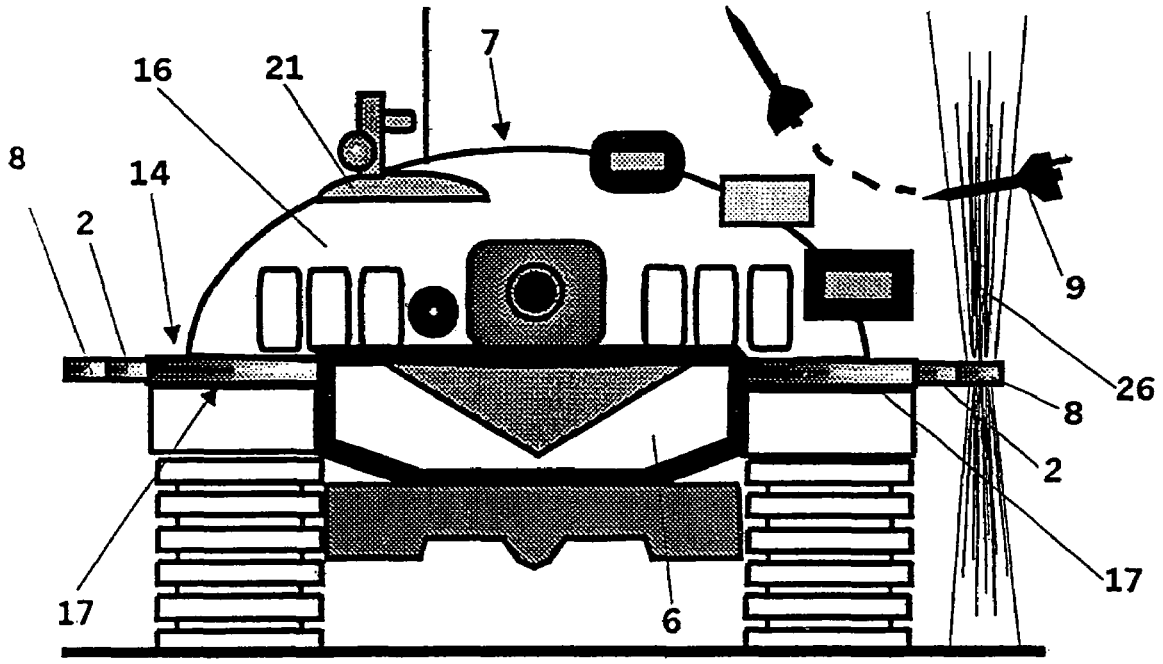
Figure 8:
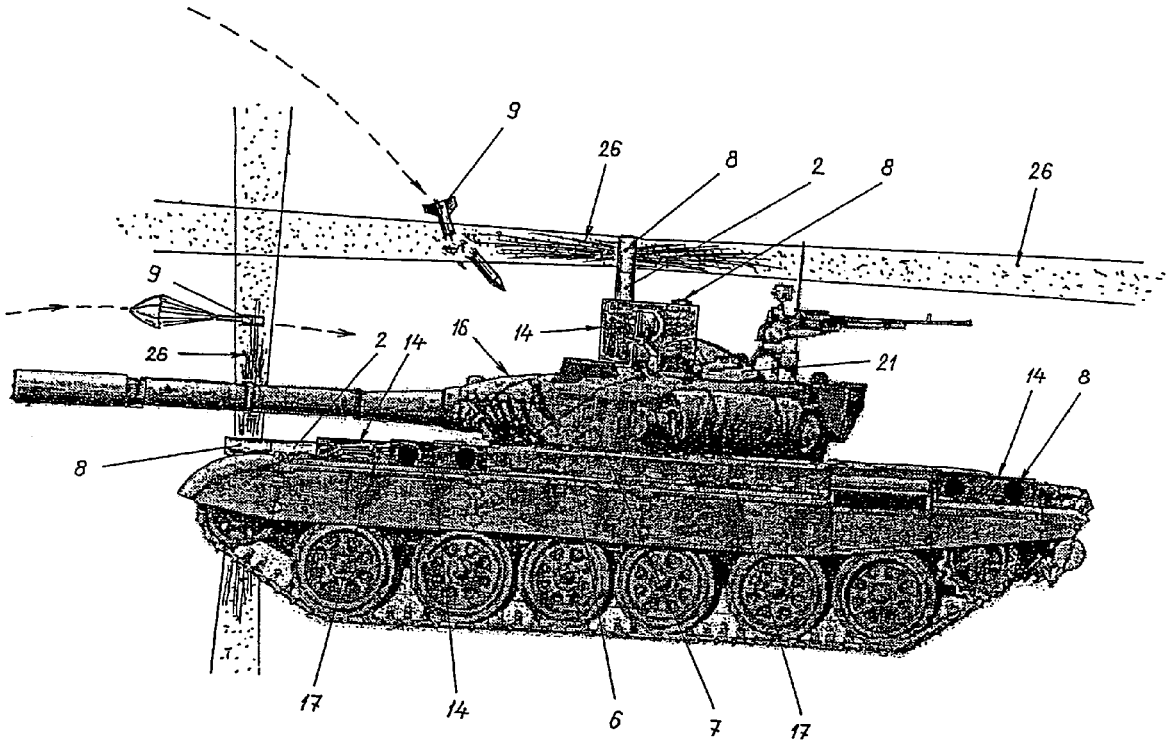

The joint length of each radar and the protective ammunition 8 ensures that during the explosion the protective ammunition 8 is moved outwardly beyond and away from the protected armored object as shown in FIGS. 6–8. First the detection system 2 is mounted on the power base 13, and then the protective ammunition 8 is mounted on its free end as shown in FIGS. 1, 2, 3. All components of the system are electrically wired by wires 20. Contacts 22 which can be formed as limit switches on hatches 21 on the protected armored object 6 are connected to the target destruction system 3 through the device for blocking fire control circuits 5, so as to block the fire control circuits while the hatches 21 of the protected armored object 6 are open as shown in FIG. 4. The front side of the armored case 14 has openings 24 for the detection systems 2 or the radars and the protective ammunition rounds as shown in FIGS. 1–3. The armored case 14 is provided with handles 25 for carrying the case to a mounting place on the protected armored object 6.

The active protection system in accordance with the present invention operates as follows:

The active protection system on the combat ready protective armored object 6 for example, a tank, is in the following mode with the hatches 21 closed:

The contacts 24 formed for example as limit switches are pressed by lids of the hatches 21, causing the electrical circuits between the control panel 4 and the target destruction system 3 to be closed. The power supply unit 19 is off. The control panel 4 is off. In order to disguise the modules, they are located on the shelves over the tracks 17, which is the place for mounting of technological cases and canisters. The modules are entirely combat ready, with the protective ammunition rounds mounted on the detection system 2 or radars, and the radars are fixed to the power base 13 of the protective ammunition moving device 8, while the power bases 13 are arranged inside the case 14.

When a crew opens the hatches 21 on the protected armored object 6, the contacts 22 are on, disconnecting the electrical circuit between the control panel 4 and the target destruction system 3, to ensure a safe entrance of the crew into the fighting compartment 7 of the protected armored object 6 and the protection from unauthorizered detonation of the protective ammunition 8.

The protective armored object 6, for example a tank, is now advancing to a battlefield. At the area of the battlefield, with the hatches 21 close, the active protection system is set to combat ready mode. For this purpose, all subsystems of the active protection system are activated by power which is supplied from the power supply unit 19 to corresponding consumer units. During this process the data and control system 1, the detection system 2, and the target destruction system 3 are turned on. A control signal is supplied to the switching unit 18, which is in stand-by mode waiting for an additional controlling signal.

After the above mentioned preparatory operations, the crew turn on the control panel 4, thus sending a controlling signal to each module. Triggered by the controlling signal, the switching unit 18 of each of the modules is transferred from the stand-by mode to the operation mode and sends a controlling signal to the device for moving the protective ammunition 8, or in other words to the electrical engine 10. The electrical engine 10 through the reducer 11, starts moving the power base 13 along the directing helical track 12, together with the target destruction system 3 including the detection system 2 and the protective ammunition 8, which are fixed to each other. While the power base 13 is moving along the directing helical track 12, the detection system 2 and the protective ammunition 8 are moved through the opening 24 outwardly beyond the armored case 14 forwardly of a front wall 23. The unit including the detection system 2 and the protective ammunition 8 is moved out over such a range which provides the delivery of the protective ammunition 8 during its explosion away from the armored case 14, as shown in FIGS. 6–8.

When the protective ammunition 8 is moved out into the combat mode upon receiving the controlling signal from the control panel 4, the data and control system 1 and the detection system 2 are set into operation. All operating detection systems 2 or radars of the modules form a circular zone of detection of incoming targets 10, with a radius of for example 2–2.5 m, as shown in FIG. 5. The active protection system in accordance with the present invention is now combat ready.

If the tank 6 provided with the above mentioned active protection system to destroy the anti-tank means 9 (for example anti tank grenades, grenades from a portable anti-tank grenades launcher, artillery shells, guided or unguided anti-tank rockets, etc.) is attacked by a target 9, the target is tracked by the detection system 2 or the radar. The signal received from the detection system 2 of one of the modules is sent to the data and control system 1, where the signal from the target 9 is identified. At the same time the module which is located at the side attacked by the anti-tank means 9 is identified.

Having established that the target 9 is threatening the tank, the data and control system 1 sends a signal to the target destruction system 3 to activate the protective ammunition 8 of the module whose detection system 2 has identified the dangerous target 9 or in other words the incoming anti-tank means. The target destruction system 3 turns on, detonating the protective ammunition 8 of the module which is at the side attacked by the tank-threatening target 9, or the incoming anti-tank means. The protective ammunition 8 explodes and forms a circular zone for the destruction of the tank-threatening target 9. The destruction zone consists of the following: a stream of high-speed splinters separated in altitude as identified by 26 in FIGS. 6–8, a shock wave, and explosion products.

The incoming anti-tank means 9 that have a thin casing, are effected by the splinters 26 and other destruction factors of the explosion, detonate or explode, and fail to reach the main armor of the protected armored object 6. It can be also thrown by the explosion force away from the protected armored object 6, where they pose no threat to the latter, as shown in FIG. 6.

The incoming anti-tank means 9 that have a solid metal casing are affected by the blow from the stream of high-speed splinters 26 separated in altitude, by the shock wave and by explosion products and stray from their original trajectory, so that they approach the main armor of the tank 6 at a certain angle which substantially reduces its armor-piercing capability, or fly nearby the protected armored object 6 if their trajectories are significantly bent.

Following the operation of the one of the protective ammunitions 8, another ammunition 8 of the same module, following the command of the data and control system 1, is automatically moved by the electric motor 10 outwardly of the armored case 15 into a combat position. After the second protective ammunition 8 is in combat ready position, this particular module as well as the entire active protection system is combat ready again.

The active protection system in accordance with the present invention has a higher efficiency when compared with the systems disclosed in the prior art including the system which is considered hereinabove as the prototype. The active protective system in accordance with the present invention provides a round view of the attack zone of incoming anti-tank means regardless of the angle of rotation of the turret of the protective armored object with respect to the trajectory of the incoming antitank means, reduces time required to gain protective ammunition at the target, provides the opportunity to intercept both slow-speed targets which fly at a speed of up to 700 m/sec and high speed targets flying at a speed 1200 m/sec. The efficiency of the active protection system is also enhanced because a stream of high-speed splinters are separated in altitude, formed during the explosion of the protected ammunition. Since the cases of the modules are composed of armored material, the modules are protected from small-caliber shells, small arms bullets, and splinters. The mounting of the armored cases with the installed modules on the shells over the tracks over the perimeter of the protected armored object at the locations of regular cases and canisters disguises the systems on the body of the protected object.

It will be understood that each of the elements described above, or two or more together, may also find a useful application in other types of constructions differing from the types described above.

While the invention has been illustrated and described as embodied in active protection systems, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is:

1. A system of active protection of objects, comprising a central control panel; and at least one unit arrangeable on a protected object and including a target detection device, a protective ammunition connected with said target detection device, a device for moving out said target detection device and said protective ammunition device, and a case accommodating said target detection device, said protective ammunition, and said moving out device, so that when said target detection device of said at least one unit detects a target, said ammunition of said at least one unit is moved out of said case and fired, wherein each of said units has a second target detection device and a second protective ammunition, and a second device for moving said second target detection device together with said second protective ammunition outwardly beyond said case, said second moving out device operating independently from said first mentioned moving out device, so that said second target detection system with said second protective ammunition can move out of said case independently from and after moving out of said first mentioned target detection device with said first mentioned protective ammunition.

2. A system as defined in claim 1, wherein said case of said at least one unit also accommodates switching means and power means.

3. A system as defined in claim 1, wherein said case is formed as an armored protective case.

4. A system as defined in claim 1, wherein said protective ammunition is connected with said moving out device through said target detection device.

5. A system as defined in claim 1, wherein said moving out device includes an electric motor and a helical rack cooperating with said target detection device to displace said target detection device together with said protective ammunition outwardly beyond said case.

6. A system as defined in claim 1, wherein said case has at least one opening through which said target detection device together with said protective ammunition is movable by said moving out device outwardly beyond said case.

7. A system as defined in claim 1; and further comprising a plurality of said units located at distances from one another to be distributed over a perimeter of the object to be protected and operating independently from one another.

8. A protected object system, comprising a protected object; and a system of active protection of said protected object, said system including a central control panel; and at least one unit arranged on the protected object and including a target detection device, a protective ammunition connected with said target detection device, a device for moving said target detection device and said protective ammunition, and a case accommodating said target detection device, said ammunition and said moving device, so that when said target detection device of said at least one unit detects a target, said ammunition of said at least one unit is moved out of said case and fired, wherein each of said units has a second target detection device and a second protective ammunition, and a second device for moving said second target detection device together with said second protective ammunition outwardly beyond said case, said second moving out device operating independently from said first mentioned moving out device, so that said second target detection system with said second protective ammunition can move out of said case independently from and after moving out of said first mentioned target detection device with said first mentioned protective ammunition.

9. A protected object system as defined in claim 8, wherein said case of said at least one unit also accommodates switching means and power means.

10. A protected system as defined in claim 8, wherein said case is formed as an armored protective case.

11. A protected object system as defined in claim 8, wherein said protective ammunition is connected with said moving out device through said target detection device.

12. A protected object system as defined in claim 8, wherein said moving out device includes an electric motor and a helical rack cooperating with said target detection device to displace said target detection device together with said protective ammunition outwardly beyond said case.

13. A protected object system as defined in claim 8, wherein said case has at least one opening through which said target detection device together with said protective ammunition is movable by said moving out device outwardly beyond said case.

14. A protected object system as defined in claim 8; and further comprising a plurality of said units located at distances from one another to be distributed over a perimeter of the object to be protected and operating independently from one another.

* * * * *